US007437838B2

(12) United States Patent
Nau

(10) Patent No.: US 7,437,838 B2
(45) Date of Patent: Oct. 21, 2008

(54) ARTICLE OF FOOTWEAR

(75) Inventor: David Nau, Wayland, MA (US)

(73) Assignee: SRL, Inc., Wilmington, DE (US)

( * ) Notice: Subject to any disclaimer, the term of this patent is extended or adjusted under 35 U.S.C. 154(b) by 322 days.

(21) Appl. No.: 11/234,465

(22) Filed: Sep. 23, 2005

(65) Prior Publication Data

US 2007/0068039 A1 Mar. 29, 2007

(51) Int. Cl.
*A43B 13/14* (2006.01)
*A43B 13/16* (2006.01)
*A43B 13/18* (2006.01)

(52) U.S. Cl. ..... 36/102; 36/25 R; 36/94

(58) Field of Classification Search ..... 36/94, 36/102, 103, 25 R, 27, 28
See application file for complete search history.

(56) References Cited

U.S. PATENT DOCUMENTS 3,100,354 A * 8/1963 Lombard et al. ..... 36/25 R
4,259,792 A * 4/1981 Halberstadt ..... 36/28
4,570,620 A 2/1986 Kurtz et al.
4,667,423 A * 5/1987 Autry et al. ..... 36/102
4,924,606 A 5/1990 Montgomery et al.
5,280,680 A * 1/1994 Burke et al. ..... 36/28
5,465,509 A 11/1995 Fuerst et al.
5,682,685 A 11/1997 Terlizzi
6,076,284 A 6/2000 Terlizzi
6,354,020 B1 * 3/2002 Kimball et al. ..... 36/29
6,895,693 B2 5/2005 Baruck
2001/0022041 A1 * 9/2001 Gebhard ..... 36/131
2002/0178615 A1 * 12/2002 Saillet et al. ..... 36/85
2004/0148803 A1 * 8/2004 Grove et al. ..... 36/103
2005/0150134 A1 * 7/2005 Issler ..... 36/102
2005/0166427 A1 * 8/2005 Greene et al. ..... 36/128
2006/0117599 A1 * 6/2006 Deem et al. ..... 36/3 B
2007/0144038 A1 * 6/2007 Ailey et al. ..... 36/44

* cited by examiner

*Primary Examiner*—Ted Kavanaugh
(74) *Attorney, Agent, or Firm*—Fish & Richardson P.C.

(57) ABSTRACT

Shoes having foot support structures formed of arm portions and/or plates having variable flexibility are disclosed.

22 Claims, 8 Drawing Sheets

ARTICLE OF FOOTWEAR

TECHNICAL FIELD

This disclosure relates to shoes.

BACKGROUND

Generally, shoes include an upper portion and a sole. When the upper portion is secured to the sole, the upper portion along with the sole define a void that is configured to securely and comfortably hold a human foot. Often, the upper portion and/or sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability, while shape, texture, and color are used to promote the aesthetic qualities of the shoe.

SUMMARY

Generally, the disclosure relates to shoes having variable flexibility, e.g., laterally, or along a longitudinal axis of the shoe. For example, shoes are disclosed that have arm portions and/or plates having variable flexibility.

In one aspect, the disclosure features shoes having an assembly including a foot support structure and a plate mounted upon the foot support structure. The foot support structure includes a cross member, and a first pair of cantilevered arm portions extending from the cross member in a heelward direction, with a first, heelward-extending gap defined therebetween. If desired, the first pair of cantilevered arm portions can be, e.g., configured to reengage in a heelward direction, spaced from the cross member. In some configurations, the cross member can be, e.g., disposed in a forefoot region of the foot support structure.

In some implementations, the foot support structure includes a second pair of cantilevered arm portions extending from the cross member in a toeward direction, with a second, toeward-extending gap defined therebetween. If desired, the second pair of cantilevered arm portions can be, e.g., configured to reengage in a toeward direction, spaced from the cross member.

In some implementations, the foot support structure defines a first, upper surface directed towards a wearer's foot when the shoe is worn and an opposite surface. The plate can be, e.g., mounted upon the first surface.

The plate can, e.g., vary in beam stiffness along a longitudinal axis of the shoe. In such instances, the beam stiffness is measured as a product of an overall moment of inertia of a nominal cross-section and an effective modulus of elasticity (Young's modulus) of a material from which the plate is formed.

The plate can, e.g., vary in thickness along a longitudinal axis of the shoe and/or can be formed from materials that vary in hardness and/or flexural modulus.

In some implementations, the plate is formed from polymeric material, e.g., a thermoplastic (e.g., a thermoplastic polyurethane). The polymeric material can have, e.g., a flexural modulus of from about 5.0 MPa to about 2000 MPa, measured at 25° C. by DMA in a linear region of a stress strain curve. In specific implementations, the polymeric material has a flexural modulus that is from about 15.0 MPa to about 1200 MPa. In some implementations, the polymeric material has a hardness of from about 50 Shore A to about 80 Shore D, as measured using ASTM D2240 at 25° C. In specific implementations, the hardness is from about 70 Shore A to about 76 Shore D.

In some implementations, the plate has a toeward portion and a heelward portion, and the heelward portion has a relatively higher beam stiffness than the toeward portion. In specific implementations, the toeward portion and the heelward portion are each formed from a polyurethane material, e.g., a thermoplastic polyurethane. Each portion can be made, e.g., by molding (e.g., co-molding). In specific implementations, the material from which the toeward portion of the plate is made has a hardness of from about 50 Shore A to about 95 Shore A and a flexural modulus of from about 5.0 MPa to about 105.0 MPa; and the material from which the rearward portion of the plate is made has a hardness of about 90 Shore A to about 76 Shore D and a flexural modulus of from about 75.0 MPa to about 1700 MPa. In some implementations, a thickness of the toeward and/or heelward portion of the plate is from about 0.25 mm to about 2.5 mm.

In some implementations, the first, heelward-extending gap defined between the first pair of cantilevered arm portions extends along at least 50 percent of a total length of the foot support structure, e.g., at least 60 percent, 65 percent, 70 percent, 75 percent, or at least 85 percent of the total length of the foot support structure.

The foot support structure can made, e.g., from a material that includes a polyolefin, e.g., ethylene-vinyl-acetate copolymer (EVA) or linear, low density polyethylene (e.g., a copolymer of ethylene and a 5-20 carbon α-olefin such as 1-octene). The foot support structure can be made, e.g., by injection molding or compression molding. The material of the foot support structure can be foamed during the forming of the foot support structure, making it, e.g., advantageously low in density, and, therefore, weight. When the material of the foot support structure is foamed, the cellular structure of the foam can be open or closed. In implementations in which the material of the foot support structure is foamed, it can, e.g., have a hardness from about 30 ASKER C to about 75 ASKER C, e.g., 40 ASKER C to about 60 ASKER C, as measured using Japanese Standard SRIS 0101 at 25° C.

In implementations in which the support structure includes a second pair of cantilevered arm portions extending from the cross member in a toeward direction, with a second, toeward-extending gap defined therebetween, a combined length of the first gap and the second gap can be, e.g., at least 50 percent of a total length of the foot support structure, e.g., at least 60 percent, 65 percent, 70 percent, 75 percent, 85 percent, or at least about 90 percent of a total length of the foot support structure.

In some implementations, the assembly is used in a sandal or a boating shoe.

In some implementations, the foot support structure also includes straps, e.g., that extend through reinforced apertures defined in the foot support structure. If desired, straps can be made releasably engageable, e.g., by applying hook-and-loop type fasteners to the straps.

If desirable, the shoe assembly can further include a liner mounted to an outer surface of the plate. This can be advantageous, e.g., for additional shock-absorbing, when desired. The liner material can, e.g., define siping extending transversely to a longitudinal axis of the shoe. This can be advantageous when extra traction and slip resistance is desired. In specific implementations, the liner is formed from foamed EVA. When the liner is formed from foamed material, it can have, e.g., a hardness from about 25 ASKER C to about 65 ASKER C, e.g., 35 ASKER C to about 55 ASKER C, as measured using Japanese Standard SRIS 010 at 25° C. When the material of the liner is foamed, the cellular structure of the foam can be open or closed.

In some implementations, the shoe assembly further includes an outsole mounted to the opposite surface of the foot support structure. Such an outsole can, e.g., increase the wear-resistance of the shoe assembly. The outsole can define siping extending transversely to a longitudinal axis of the shoe. In specific implementations, the outsole is formed from vulcanized rubber material, e.g., a natural rubber material. In some implementations, the outsole is formed from a material having a hardness from about 40 Shore A to about 95 Shore A, e.g., from about 50 Shore A to about 80 Shore A, as measured using ASTM D2240 at 25° C.

In another aspect, the disclosure features shoes having an assembly having a foot support structure and a top plate mounted upon the foot support structure. The foot support structure includes a cross member, and a first pair of cantilevered arm portions extending from the cross member in a toeward direction, with a first, toeward-extending gap defined therebetween. If desired, the first pair of cantilevered arm portions can, e.g., be configured to reengage in a toeward direction, spaced from the cross member. In some configurations, the cross member can be, e.g., disposed in a forefoot region of the foot support structure. Any of the features described above with respect to the first aspect can be applied to this aspect.

In another aspect, the disclosure features a shoe that includes a plate formed of at least two different materials. For example, the plate can have a toeward portion and a heelward portion. In such implementations, the heelward portion can, e.g., have a relatively higher beam stiffness than the toeward portion. In specific implementations, the toeward portion includes a polymeric material having a hardness of from about 50 Shore A to about 95 Shore A and a flexural modulus of from about 5.0 MPa to about 115.0 MPa; and the rearward portion includes a polymeric material having a hardness of about 85 Shore A to about 80 Shore D and a flexural modulus of from about 75.0 MPa to about 1900 Mpa.

In another aspect, the disclosure features shoes having a foot support structure that includes a cross member, and a first pair of cantilevered arm portions extending from the cross member in a heelward direction, with a first, heelward-extending gap defined therebetween. If desired, the first pair of cantilevered arm portions can be, e.g., configured to reengage in a heelward direction, spaced from the cross member. In some configurations, the cross member can be, e.g., disposed in a forefoot region of the foot support structure. In some implementations, the foot support structure includes a second pair of cantilevered arm portions extending from the cross member in a toeward direction, with a second, toeward-extending gap defined therebetween. If desired, the second pair of cantilevered arm portions can be, e.g., configured to reengage in a toeward direction, spaced from the cross member. Any of the other features described herein with respect to the foot support structure can be applied to this aspect.

Implementations may include any one, or combination of the following advantages. The shoes described herein flex naturally along with the wearer's feet, allowing the wearer to control his/her movement as if they were barefoot, while at the same time providing adequate protection for the wearer. The shoes are lightweight. The shoes have enhanced breathability, providing many hours of continuous comfort.

The details of one or more implementations are set forth in the accompanying drawings and the description below. Other features, and advantages of the disclosure will be apparent from the description and drawings, and from the claims.

DETAILED DESCRIPTION

Figure 1:
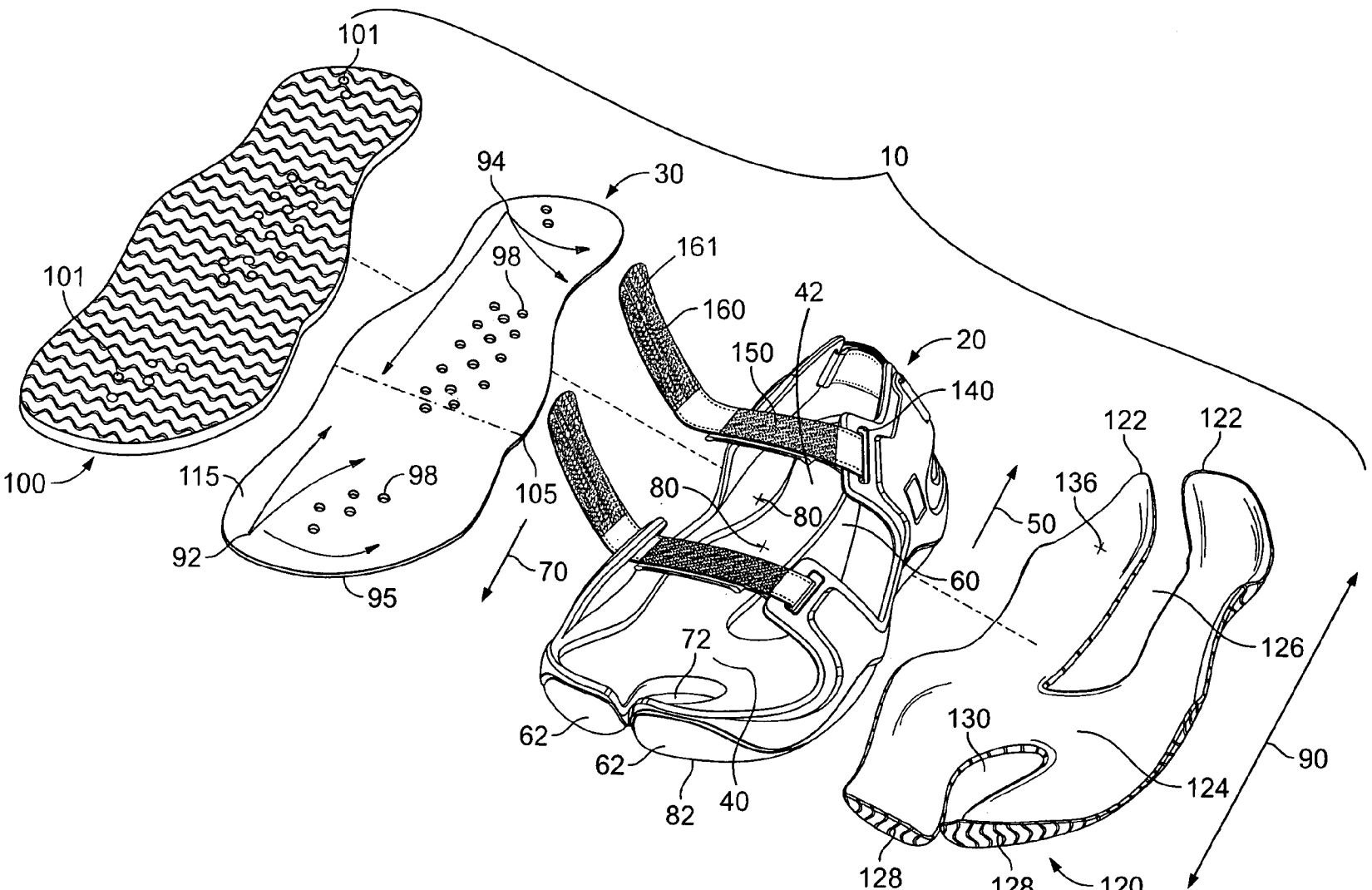
FIG. 1 is an exploded, perspective view of a left foot sandal assembly having a foot support structure having both toeward and heelward cantilevered arm portions, an outsole, a plate and a liner.

Referring to FIGS. 1, 2, 2A-2H and 3A and 3B, a sandal has an assembly 10 that includes a foot support structure 20 and a top plate 30 mounted upon foot support structure 20. Support structure 20 includes a forefoot cross member 40 and a first pair of cantilever arm portions 42 extending from the forefoot cross member 40 in a heelward direction (direction indicated by arrow 50), with a first, heelward-extending gap 60 defined therebetween. Foot support structure 20 also includes a second pair of cantilevered arm portions 62 extending from the forefoot cross member 40 in a toeward direction (direction indicated by arrow 70), with a second, toeward-extending gap 72 defined therebetween. In the implementation shown, foot support structure 20 defines a recessed first, upper surface 80 directed towards a wearer's foot when the shoe is worn, and an opposite, second, lower surface 82 directed towards a walking surface. Recessed upper surface 80 is configured to accept the plate 30, which is mounted via bottom surface 95, e.g., by adhesive or solvent bonding, upon the first, upper surface 80 of the foot support structure 20. As shown, plate 30 defines a plurality of apertures 98 in locations that correspond to first and second gaps 60 and 72 (perhaps best seen in FIG. 2). Shoe assembly 10 also defines a liner 100 that includes a plurality of apertures 101 that line up with apertures 98 of plate 30 when the liner 100 is mounted to a first, upper surface 115 of top plate 30. Having the apertures 101 of liner 100 and apertures 98 of plate 30 in alignment can allow for effective air circulation through the sandal. In addition, assembly 10 includes an outsole 120 mounted to the opposite, second, lower surface 82 of the foot support structure 20. As shown, the outsole 120 includes a first pair of cantilevered arm portions 122 extending from an outsole cross member 124 in a heelward direction, with a first, heelward-extending gap 126 defined therebetween, and a second pair of cantilevered arm portions 128 extending from the outsole cross member 124 in a toeward direction, with a second, toeward gap 130 defined therebetween. When outsole 120 is mounted by a top surface 136 to the lower surface 82 of foot support structure 20, the first and second pair of cantilevered arm portions 122 and 128 are aligned with the first and second cantilevered arm portions 42 and 62 of foot support structure 20. Such a construction can allow for the sandal to flex naturally along with the wearer's foot, allowing the wearer to control his/her movement as if they were barefoot, while at the same time providing adequate protection to the wearer's feet.

In some implementations, top plate 30 varies in beam stiffness along a longitudinal axis (indicated by double-headed arrow 90) of the shoe. The beam stiffness is measured as a product of an overall moment of inertia of a nominal cross-section and an effective modulus of elasticity (Young's modulus) of a material from which the plate is formed. Beam stiffness can be varied by varying material hardness and/or flexural modulus and/or thickness of the plate 30.

In some implementations, top plate 30 is formed of polymeric material, e.g., thermoplastic or thermoset polymeric material. The thermoplastic material can be, e.g., an elastomer, e.g., natural rubber, blends of styrenic block copolymers and polypropylene, elastomeric nylons (e.g., polyetheramides) or polyurethanes. In specific implementations, the thermoplastic is a polyurethane, e.g., polyether or polyester soft-segment polyurethane, such as those available from Dow Plastics under the tradename PELLETHANE™ AND ISOPLAST™. In some implementations, the polymeric material has flexural modulus of from about 2.5 MPa to about 2100 Mpa, e.g., from about 5.0 MPa to about 500 Mpa, as measured at 25° C. by DMA in a linear region of a stress strain curve. In some implementations, the polymeric material has hardness of from about 50 Shore A to about 85 Shore D, e.g., from about 75 Shore A to about 76 Shore D, as measured using ASTM D2240 at 25° C.

Referring again particularly to FIG. 1, plate 30 includes a toeward portion 92 and a heelward portion 94 (demarcation of portions indicated generally by dotted line 105). The heelward portion 94 has a relatively higher beam stiffness than the toeward portion 92, allowing toeward portion 92 to flex more easily than heelward portion 94 when the wearer walks. In the particular embodiment shown, the beam stiffness of portions 92 and 94 is varied by making the portions out of materials having a different hardnesses and/or flexural moduli. In such implementations, plate 30 can be formed, e.g., by molding (e.g., co-molding).

In some implementations, the material of the toeward portion 92 of plate 30 has hardness of from about 80 Shore A to about 95 Shore A, flexural modulus of from about 5.0 MPa to about 85.0 MPa and a thickness from about 0.25 mm to about 2.5 mm; and the material of the rearward portion 94 of plate 30 has hardness of about 95 Shore A to about 80 Shore D, flexural modulus of from about 75.0 MPa to about 1700 MPa, and a thickness from about 0.25 mm to about 2.5 mm.

In a specific example, the material of the toeward portion 92 of plate 30 has hardness of from about 90 Shore A and a thickness of 1.5 mm; and the material of the rearward portion 94 of plate 30 has hardness of about 74 Shore D and a thickness 1.5 mm.

In some implementations, a combined length of the second, toeward-extending gap 72 and the first, heelward-extending gap 60 is at least 50 percent of a total length L (see FIG. 3A) of the foot support structure, e.g., at least 60 percent, 65 percent, 70 percent, 75 percent, 80 percent, 85 percent, or at least about 90 percent of the total length of the foot support structure 20.

Foot support structure 20, liner 100 and outsole 120 can each independently be formed of thermoset material, e.g., natural rubber, or thermoplastic, e.g., polyolefin material. For example, the thermoplastic material can be an elastomer, e.g., styrenic block copolymer, polyethylene, linear, low density polyethylene (e.g., a copolymer of 1-octene and ethylene), polyurethane (e.g., a polyether or polyester soft-segment polyurethane), elastomeric polyester (e.g., polyether-polyester), and mixtures of these elastomers. In specific implementations, support structure 20 is formed by injection molding using ethylene-vinyl-acetate copolymer (EVA) and a foaming agent, e.g., an exothermic or endothermic foaming agent. Chemical foaming agents are available from Clariant Corporation under the tradename HYDROCEROL®. When the material is foamed, the cellular structure of the foam can be open or closed.

In some implementations, support structure 20 has a maximum thickness, measured from lower surface 82 to upper surface 80, of from about 15.0 mm to about 35.0 mm, e.g., from about 18.0 mm to about 25.0 mm. In specific implementations, the material of support structure 20 is a foam having hardness of from about 30 ASKER C to about 75 ASKER C, e.g., 40 ASKER C to about 60 ASKER C, as measured using Japanese Standard SRIS 0101 at 25° C. In a specific example, the foam has hardness of about 53 ASKER C.

Figure 2:
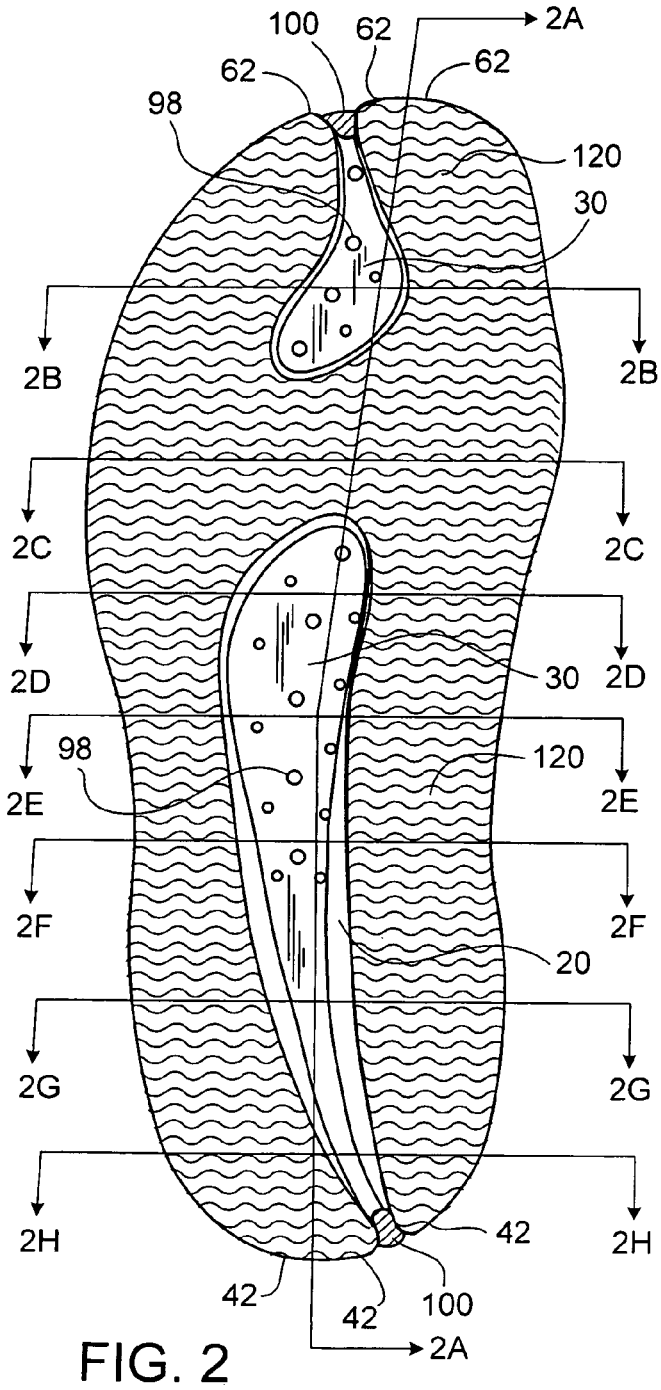
FIG. 2 is a bottom view of a right foot sandal assembly having toeward and heelward cantilevered arm portions like those of FIG. 1.
Figure 2A:
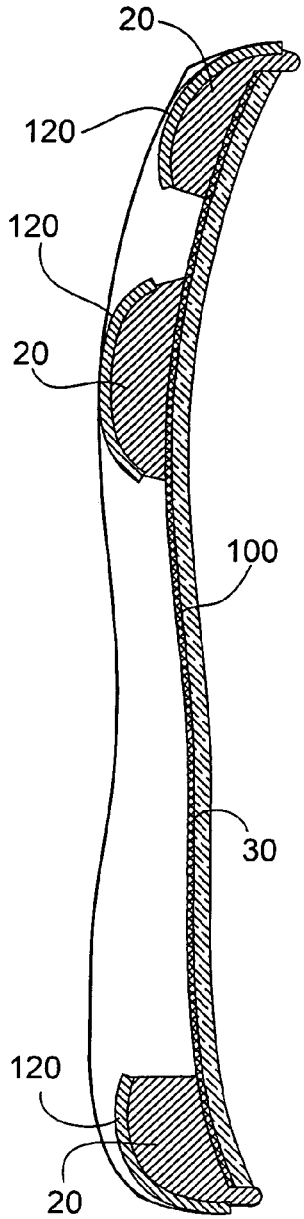
FIG. 2A is a cross-sectional view of the sandal assembly of FIG. 2, taken along line 2A-2A (siping not shown on either the liner nor outsole in cross-sections 2A-2H).
Figure 2D:
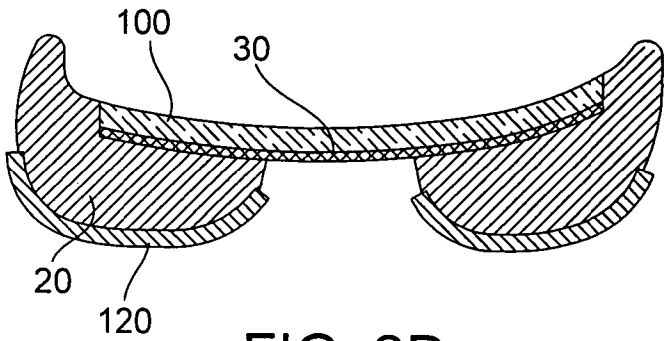
FIG. 2D is a cross-sectional view of the sandal assembly of FIG. 2, taken along line 2D-2D.
Figure 2E:
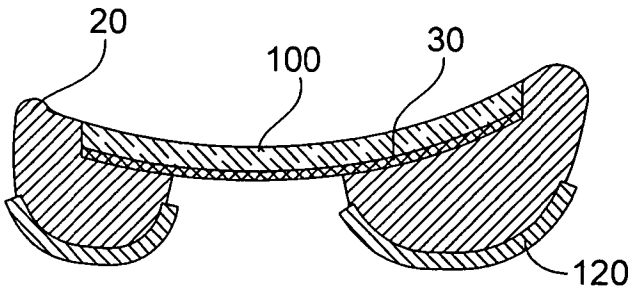
FIG. 2E is a cross-sectional view of the sandal assembly of FIG. 2, taken along line 2E-2E.
Figure 2B:
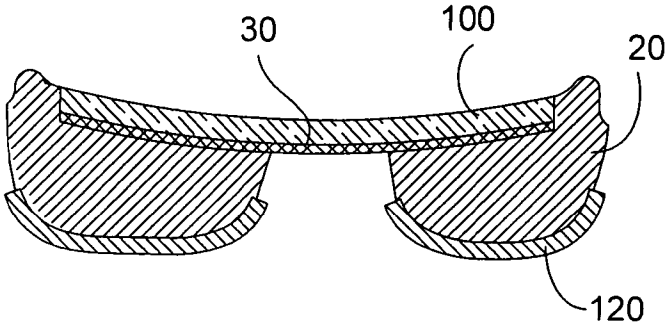
FIG. 2B is a cross-sectional view of the sandal assembly of FIG. 2, taken along line 2B-2B.
Figure 2C:
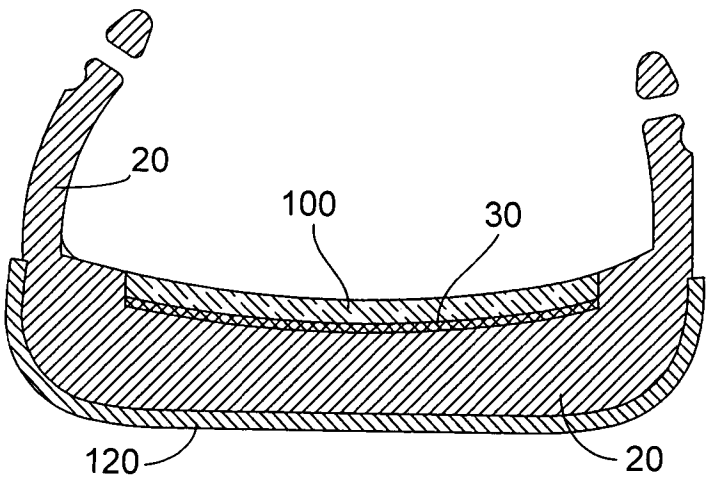
FIG. 2C is a cross-sectional view of the sandal assembly of FIG. 2, taken along line 2C-2C.
Figure 2F:
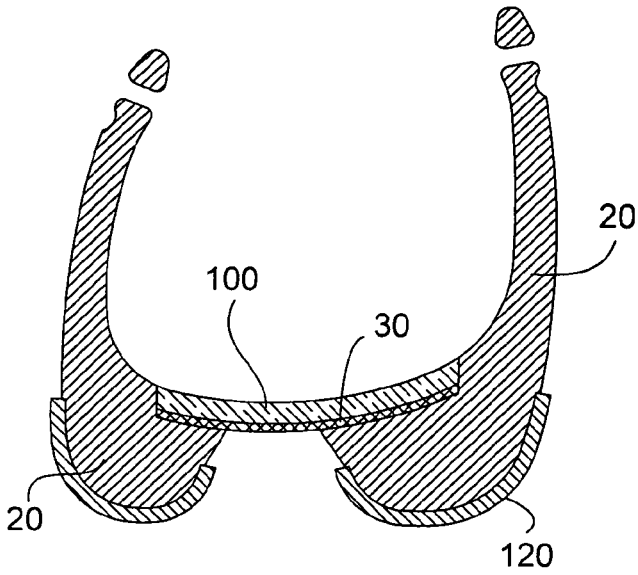
FIG. 2F is a cross-sectional view of the sandal assembly of FIG. 2, taken along line 2F-2F.
Figure 2G:
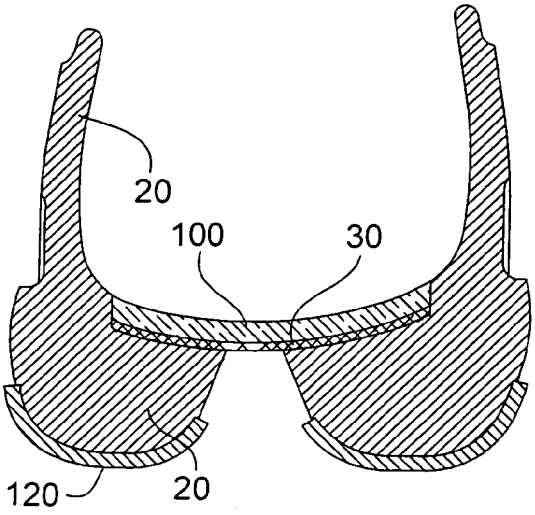
FIG. 2G is a cross-sectional view of the sandal assembly of FIG. 2, taken along line 2G-2G
Figure 2H:
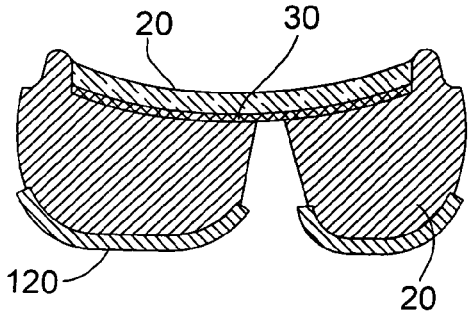
FIG. 2H is a cross-sectional view of the sandal assembly of FIG. 2, taken along line 2H-2H.

Referring to FIGS. 1 and 2, liner 100 and outsole 120 can define siping that extends transversely to a longitudinal axis, e.g., for enhanced traction or gripping. In some implementations, liner 100 and/or outsole 120 is between about 0.5 mm and 5.0 mm thick, e.g., between about 1.0 mm to about 4.0 mm, or between about 1.5 mm and 4.0 mm thick. In specific implementations, the material of liner 100 is a foam having hardness of from about 30 ASKER C to about 55 ASKER C, e.g., 35 ASKER C to about 50 ASKER C, as measured using Japanese Standard SRIS 0101 at 25° C. In a specific example, the foam has hardness of about 40 ASKER C. When the material is foamed, the cellular structure of the foam can be open or closed.

Figure 3A:
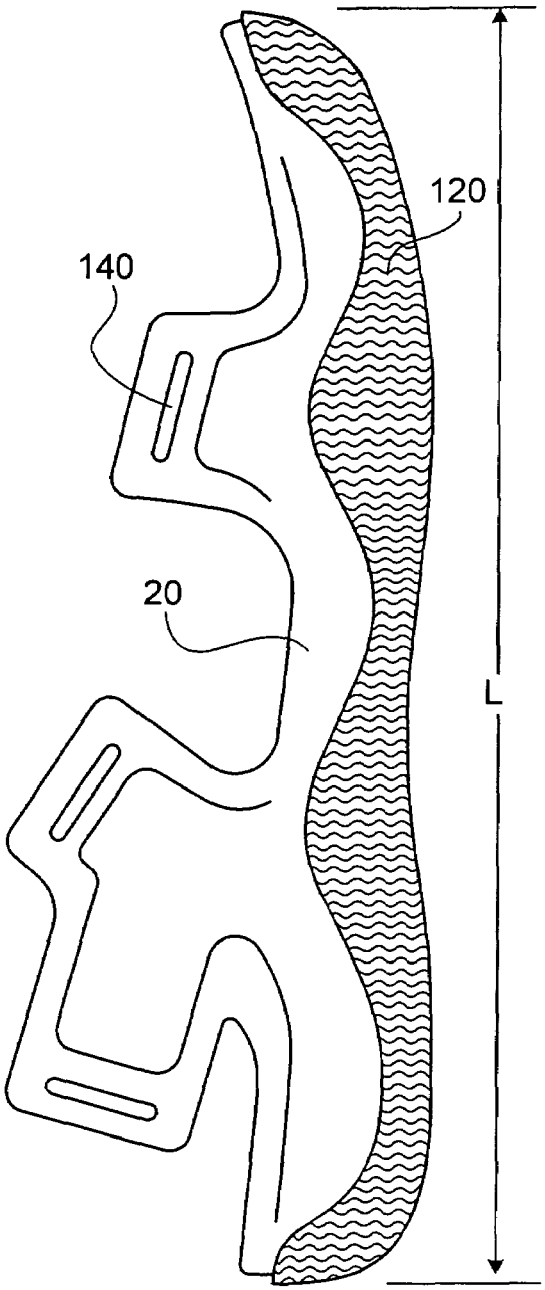
FIG. 3A is an outer side view of the sandal assembly of FIG. 2.
Figure 3B:
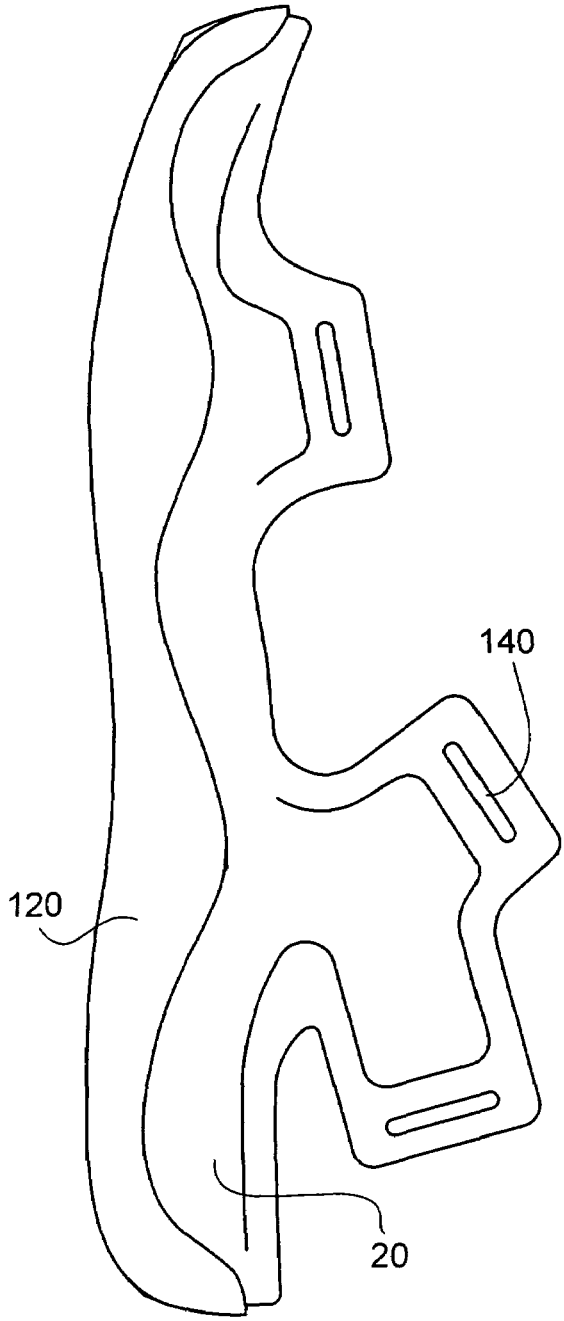
FIG. 3B is an inner side view of the sandal assembly of FIG. 2.

Referring to FIGS. 1 and 3A, foot support structure 20 can also include straps 161 that extend through apertures 140, e.g., apertures reinforced with a collar (described below), defined in support structure 20. In this particular implementations, straps are made releasably engageable by complementary hook 150 and loop 160 material, forming a hook-and-loop type fastener.

Other Embodiments

A number of implementations have been described. Nevertheless, it will be understood that various modifications may be made without departing from the spirit and scope of the disclosure.

Figure 4:
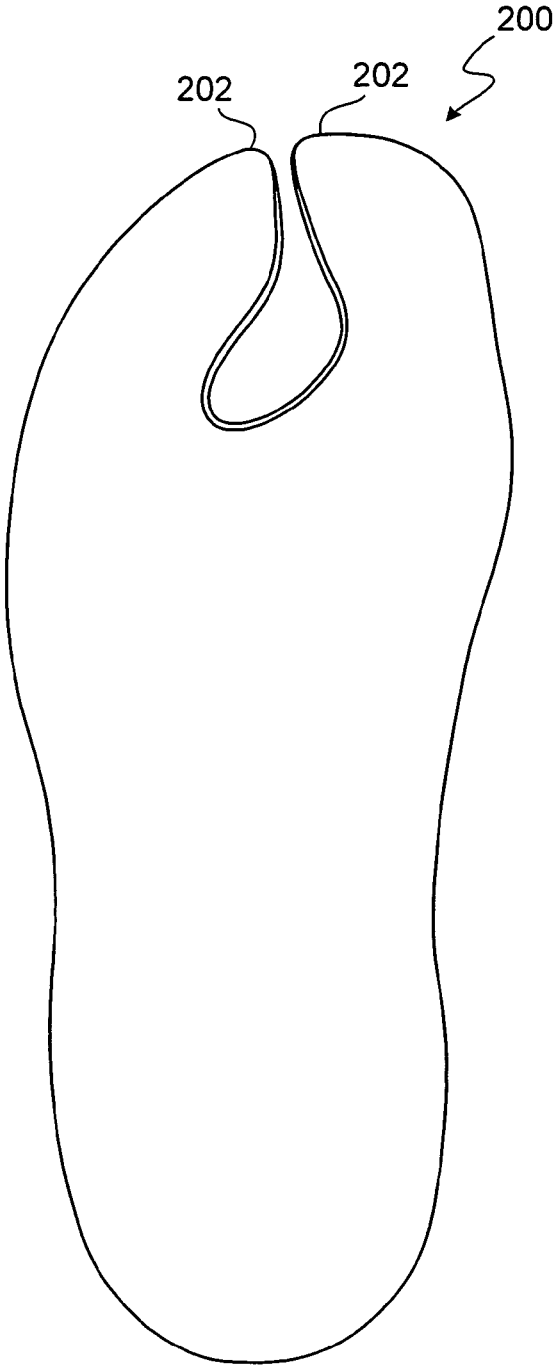
FIG. 4 is a bottom view of an alternative foot support structure having only toeward cantilevered arm portions.

While implementations have been shown in which the foot support structure has both heelward and toeward extending cantilevered arm portions, in some implementations, the foot support structure has only heelward or only toeward cantilevered arm portions. For example, referring to FIG. 4, a foot support structure 200 is illustrated having only a pair of toeward extending cantilevered arm portions 202. In such instances, the shoe assembly can generally include all the other features described herein in reference to FIGS. 1, 2, 2A-2H and 3A and 3B. For example, the shoe assembly can include a plate, e.g., a plate having two different beam stiffnesses, an outsole and a liner.

Figure 5:
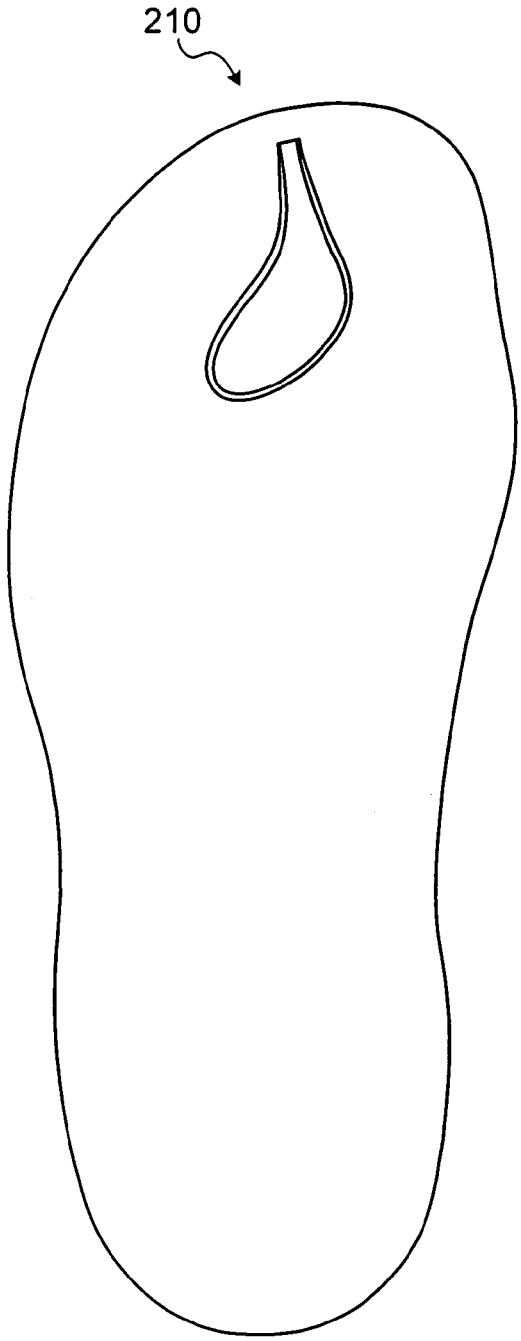
FIG. 5 is a bottom view of an alternative foot support structure having toeward cantilevered arm portions that reengage.
Figure 6:
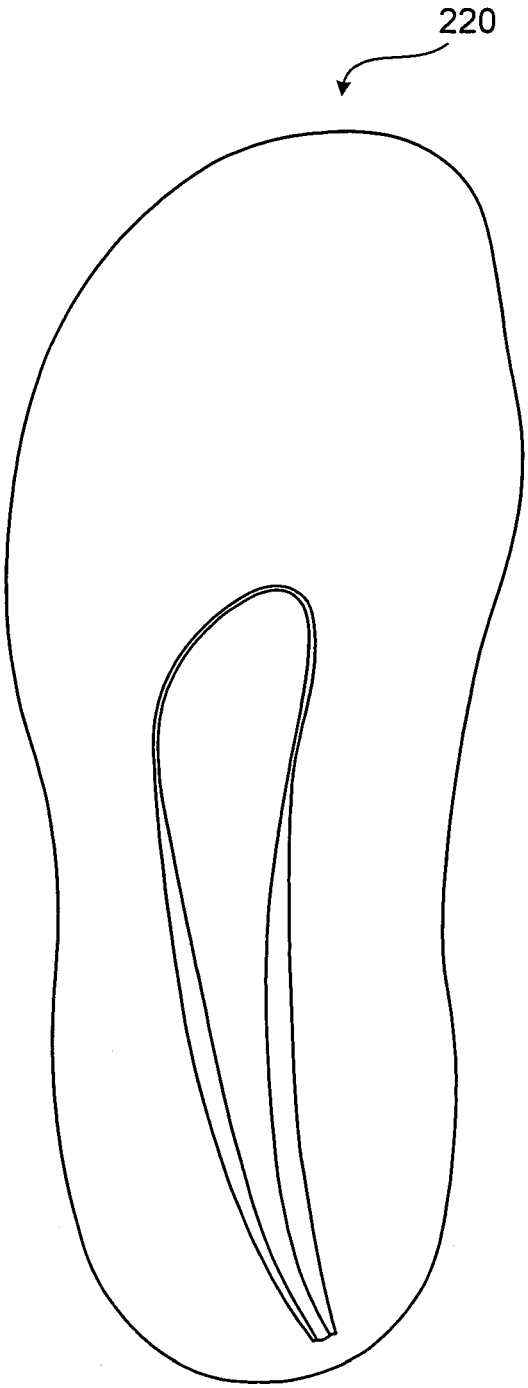
FIG. 6 is a bottom view of an alternative foot support structure having heelward cantilevered arm portions that reengage.
Figure 7:
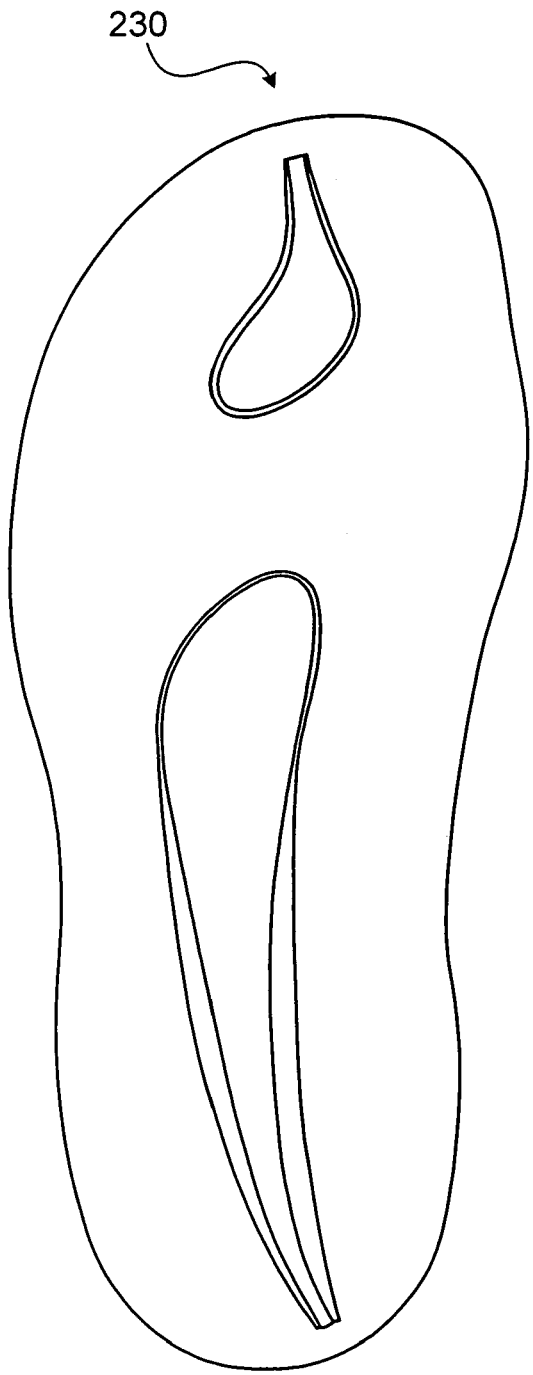
FIG. 7 is a bottom view of an alternative foot support structure having heelward and toeward cantilevered arm portions that reengage.

While implementations have been shown in which foot support structures have cantilevered arm portions that do not reengage, in some implementations, the arm portions may reengage. For example, FIG. 5 illustrates a foot support structure 210 having only toeward extending cantilevered arm portions that reengage in a toeward direction; FIG. 6 illustrates a foot support structure 220 having only heelward extending cantilevered arm portions that reengage in a heelward direction; and FIG. 7 illustrates a foot support structure 230 having both heelward and toeward cantilevered arm portions that reengage. In any such instances, the shoe assembly can generally include all the other features described herein with reference to FIGS. 1, 2, 2A-2H and 3A and 3B. For example, any such shoe assembly can include a plate, e.g., a plate having two different beam stiffnesses, an outsole and a liner.

While implementations have been shown in which cross members are generally disposed in the forefoot of the foot support structure, in other implementations, such cross members may be disposed in other locations, e.g., locations central to the foot support structure.

Figure 8:
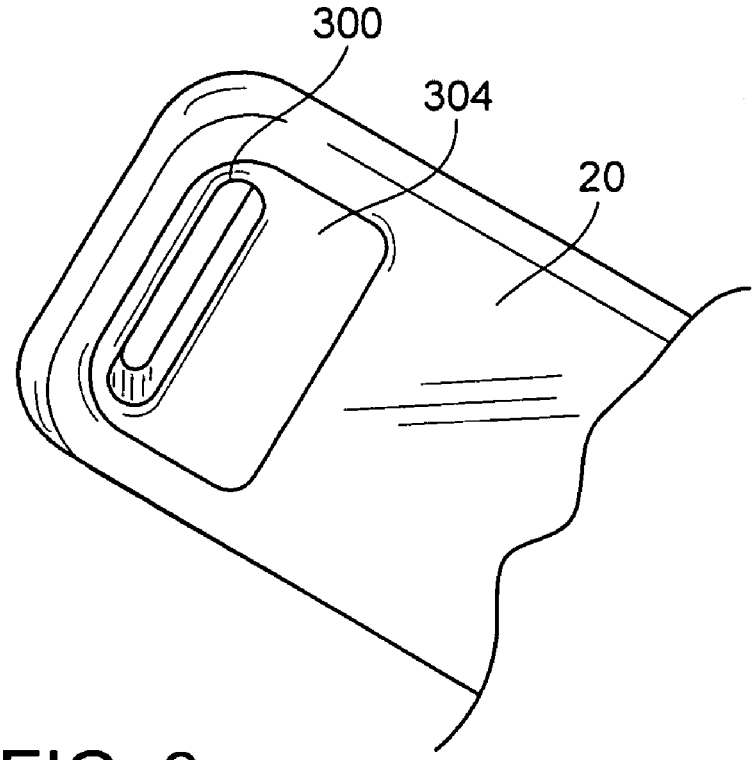
FIG. 8 is an inner perspective view of a portion of a foot support structure having reinforced apertures.
Figure 9:
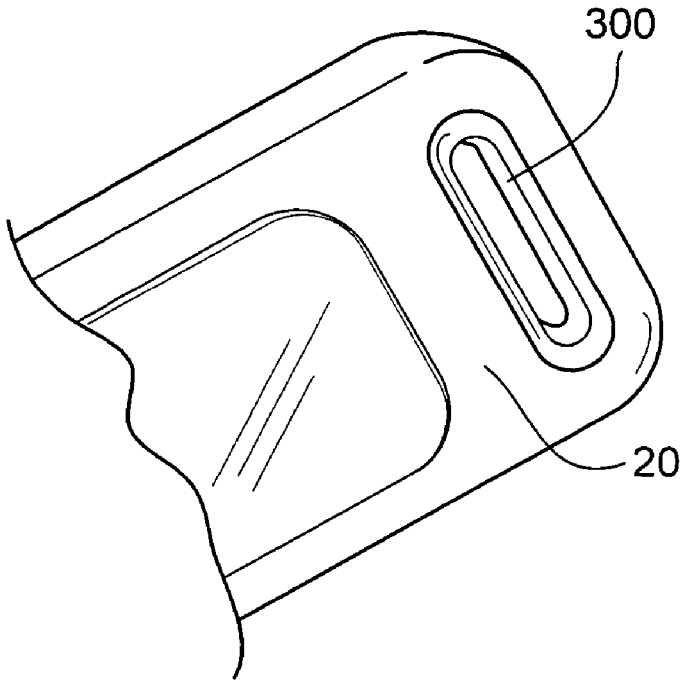
FIG. 9 is an outer perspective view of the portion of the foot support structure shown in FIG. 8

FIGS. 8 and 9, which are inner and outer perspective views, respectively, illustrate a support member 20 having apertures that are reinforced with collars 300. Collars can, e.g., strengthen the support member in the area about the apertures so that the support member resists tearing when the straps are tightened. In the particular embodiment shown, collar 300 is asymmetric in that the portion that is configured to reside on the inside of the support member includes a tab 304. In some embodiments, the collars are press fit into the apertures, and then the tab 304 is bonded to, e.g., by using an adhesive, to the support structure. Tab 304 can, e.g., aid in reinforcing the area about the apertures by distributing an applied load over a larger surface area of the support structure. In some embodiments, tab 304 is made from a thermoplastic, e.g., a thermoplastic polyurethane.

Accordingly, other implementations are within the scope of the following claims.

What I claim is:

1. A shoe having an assembly comprising:

a foot support structure having a toeward portion and a heelward portion, the foot support structure comprising:

a cross member disposed generally between the toeward portion and the heelward portion and extending across substantially the entire width of the foot support structure, and a first pair of cantilevered arm portions extending from the cross member in a heelward direction into the heelward portion, with a first, heelward-extending at least partially U-shaped gap defined therebetween; and a plate mounted upon the foot support structure.

2. The shoe of claim 1, wherein the first pair of cantilevered arm portions reengage in a heelward direction, spaced from the cross member.

3. The shoe of claim 1, further comprising a second pair of cantilevered arm portions extending from the cross member in a toeward direction, with a second, toeward-extending gap defined therebetween.

4. The shoe of claim 3, wherein a combined length of the first, heelward-extending gap and the second, toeward-extending gap is at least 50 percent of a total length of the foot support structure.

5. The shoe of claim 1, wherein the second pair of cantilevered arm portions reengage in a toeward direction, spaced from the cross member.

6. The shoe of claim 1, wherein the foot support structure defines a first, upper surface directed towards a wearer's foot when the shoe is worn, and an opposite, second, lower surface directed towards a walking surface, and wherein the plate is mounted upon the first, upper surface of the foot support structure.

7. The shoe of claim 6, wherein the shoe assembly further comprises a liner material mounted to the first, upper surface of the plate.

8. The shoe of claim 6, wherein the shoe assembly further includes an outsole mounted to the opposite, second, lower surface of the foot support structure.

9. The shoe of claim 1, wherein the plate varies in beam stiffness along a longitudinal axis of the shoe, the beam stiffness being measured as a product of an overall moment of inertia of a nominal cross-section and an effective modulus of elasticity (Young's modulus) of a material from which the plate is formed.

10. The shoe of claim 1 or claim 9, wherein the plate is formed of polymeric material.

11. The shoe of claim 10, wherein the polymeric material comprises thermoplastic polyurethane.

12. The shoe of claim 10, wherein the polymeric material has a flexural modulus of from about 5.0 MPa to about 1200 MPa measured at 25° C. by DMA in a linear region of a stress strain curve.

13. The shoe of claim 10, wherein the polymeric material has a hardness of from about 50 Shore A to about 80 Shore D measured using ASTM D2240 at 25° C.

14. The shoe of claim 1, wherein the plate has a toeward portion and a heelward portion, the heelward portion having relatively higher beam stiffness than the toeward portion.

15. The shoe of claim 14, wherein the toeward portion comprises polymeric material having hardness of from about 50 Shore A to about 95 Shore A and flexural modulus of from about 5.0 MPa to about 85.0 MPa; and the rearward portion comprises polymeric material having hardness of about 90 Shore A to about 76 Shore D and flexural modulus of from about 75.0 MPa to about 1700 Mpa.

16. The shoe of claim 14, wherein each of the toeward portion and the heelward portion has a thickness from about 0.25 mm to about 2.5 mm.

17. The shoe of claim 1, wherein the first, heelward-extending gap defined between the first pair of cantilevered arm portions extends along at least 50 percent of a total length of the foot support structure.

18. The shoe of claim 1, wherein the foot support structure comprises a polyolefin.

19. The shoe of claim 18, wherein the polyolefin comprises ethylene-vinyl-acetate copolymer (EVA).

20. A shoe having an assembly comprising:

a foot support structure having a toeward portion and a heelward portion, the foot support structure comprising:

a cross member disposed generally between the toeward portion and the heelward portion and extending across substantially the entire width of the foot support structure, and a first pair of cantilever arm portions extending from the cross member in a toeward direction, with a first, toeward-extending at least partially U-shaped gap defined therebetween;

a second pair of cantilevered arm portions extending from the cross member in a heelward direction into the heelward portion, with a second, heelward-extending at least partially U-shaped gap defined therebetween; and a plate mounted upon the foot support structure.

21. The shoe of claim 20, wherein the first pair of cantilevered arm portions reengage in a toeward direction, spaced from the cross member.

22. The shoe of claim 20, wherein the cross-member is disposed in a forefoot region of the shoe.

* * * * *